US005324161A

United States Patent [19]

Thobe

[11] Patent Number: 5,324,161

[45] Date of Patent: Jun. 28, 1994

[54] REFUSE RECEPTACLE CHARGING HOPPER

[76] Inventor: Helmut B. Thobe, 909 Waverley Rd., Glen Waverley, 3150 in the State of Victoria, Australia

[21] Appl. No.: 836,300

[22] PCT Filed: Aug. 30, 1990

[86] PCT No.: PCT/AU90/00386

§ 371 Date: Apr. 24, 1992

§ 102(e) Date: Apr. 24, 1992

[87] PCT Pub. No.: WO91/03412

PCT Pub. Date: Mar. 21, 1991

[30] Foreign Application Priority Data

Sep. 1, 1989 [AU] Australia ..... PJ6097

[51] Int. Cl.[5] ..... B65F 3/14; B30B 7/00

[52] U.S. Cl. ..... 414/525.2; 414/406; 414/525.51; 414/679; 100/233

[58] Field of Search ..... 414/406, 407, 408, 517, 414/525.2, 679, 304, 156, 198, 493, 325, 525.51; 100/233

[56] References Cited

U.S. PATENT DOCUMENTS

| | | | |
|---|---|---|---|
| 2,836,316 | 5/1958 | Schonrock | 414/493 |
| 2,879,906 | 3/1959 | Gwinn, Jr. | 414/525.4 |
| 2,914,205 | 11/1959 | Trubinski | 414/525.4 X |
| 3,130,845 | 4/1964 | French et al. | 414/406 |
| 3,220,586 | 11/1965 | Gollnick . | |
| 3,370,525 | 9/1965 | Bowles . | |
| 3,874,529 | 4/1975 | Gollnick . | |
| 3,881,407 | 5/1975 | Goar | 100/233 X |
| 3,881,613 | 5/1975 | Torimoto et al. . | |
| 4,050,594 | 9/1977 | Gollnick | 414/525.4 X |
| 4,298,306 | 11/1981 | Chaudorge . | |
| 4,637,306 | 1/1987 | Bricaud et al. . | |
| 4,876,228 | 11/1988 | Mazzocchia et al. . | |
| 4,892,454 | 1/1990 | Behling et al. | 414/406 |

FOREIGN PATENT DOCUMENTS

| | | | |
|---|---|---|---|
| 1440476 | 12/1977 | Australia . | |
| 8717875 | 9/1978 | Australia . | |
| 5057590 | 9/1990 | Australia . | |
| 925037 | 3/1955 | Fed. Rep. of Germany . | |
| 2027797 | 12/1970 | Fed. Rep. of Germany . | |
| 2035168 | 2/1971 | Fed. Rep. of Germany . | |
| 3212209 | 10/1983 | Fed. Rep. of Germany . | |
| 3345758 | 6/1985 | Fed. Rep. of Germany | 414/525.2 |
| 2373462 | 7/1978 | France . | |
| 2591203 | 6/1987 | France . | |

*Primary Examiner*—Michael S. Huppert
*Assistant Examiner*—Stephen Gordon
*Attorney, Agent, or Firm*—Andrus, Sceales, Starke & Sawall

[57] ABSTRACT

Material handling apparatus comprising a charging hopper (3) having an upper first opening (6) through which material can be loaded into the charging hopper (3) and a lower second opening (7) through which material can be discharged from the charging hopper (3). The apparatus includes a control member (10) having a work head (12) which is mounted for movement within the charging hopper (3) about a pivot axis (20) which extends generally laterally with respect to the normal upright operative position of the apparatus, the control member (10) being pivotally movable about the pivot axis (20) between a first position in which the work head (12) is spaced from and disposed above the second opening (7), and a second position in which the work head is adjacent or within the second opening (7).

9 Claims, 3 Drawing Sheets

FIG. 1
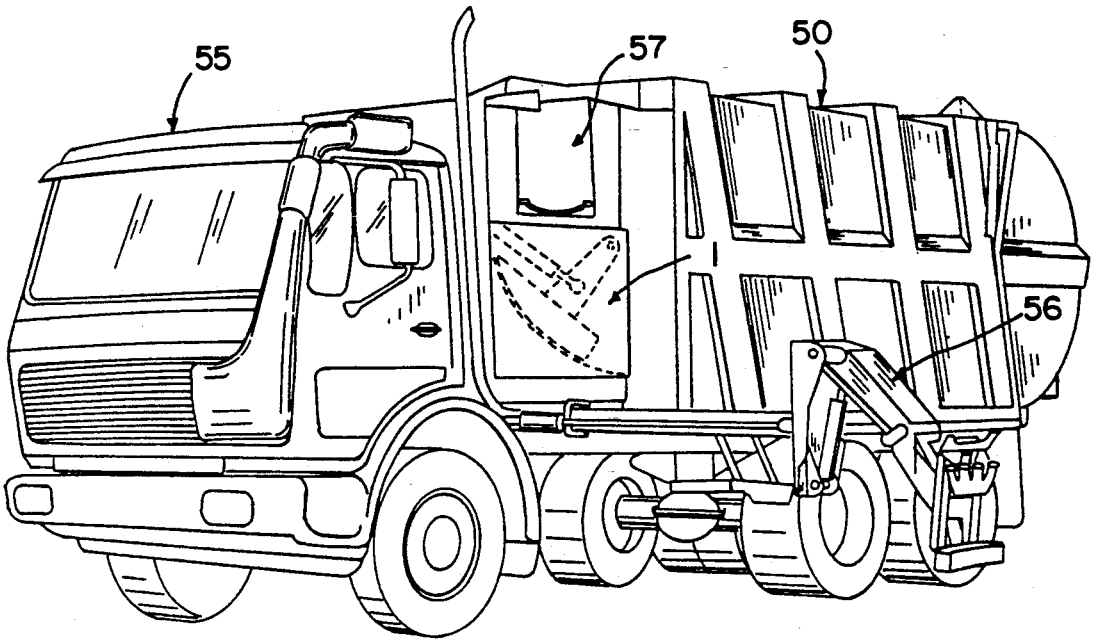
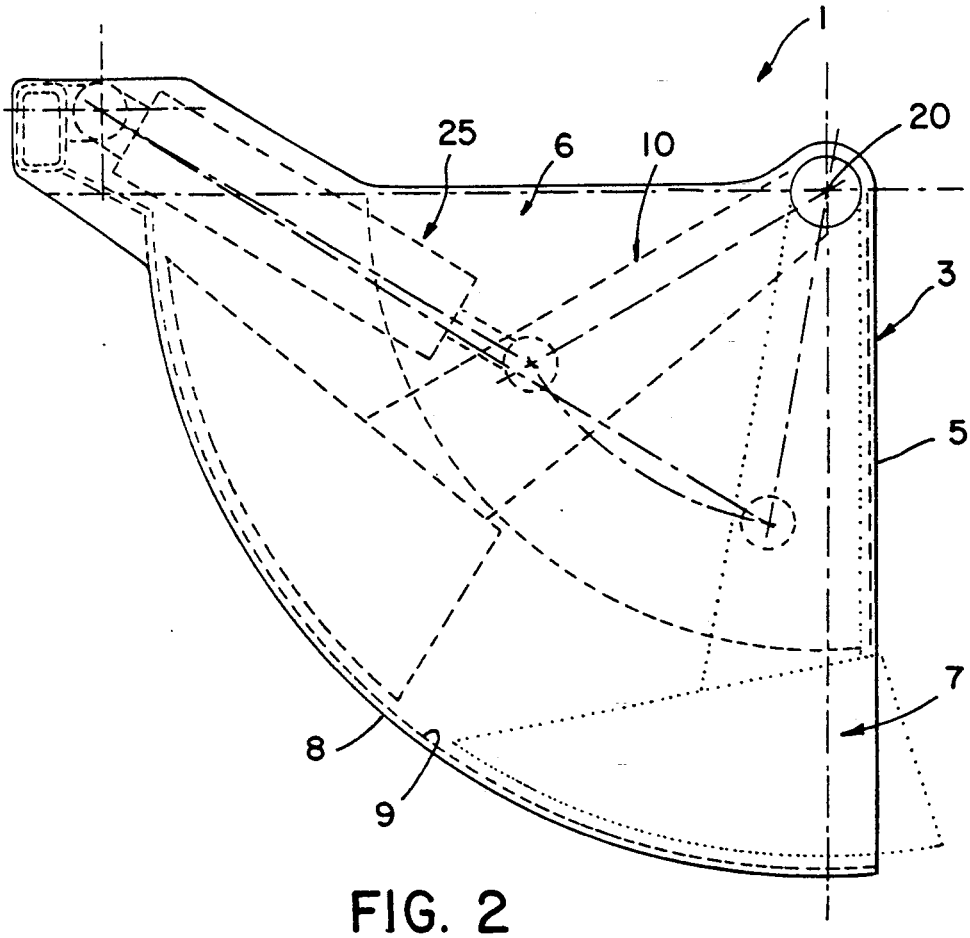
FIG. 2

REFUSE RECEPTACLE CHARGING HOPPER

This invention relates generally to material handling apparatus and more particularly, though not exclusively, to apparatus suitable for handling refuse.

One type of known refuse handling apparatus includes a loading mechanism which feeds refuse to a holding receptacle whenever the refuse is compressed or compacted by a ram or press which forms part of the loading mechanism. Such apparatus is usually mounted on a truck or like vehicle and can be used in the collection of domestic refuse. Examples of such devices are described in U.S. Pat. Nos. 3,874,529, 3,881,613, 4,050,594, 4,298,306, 4,637,306 and 4,786,228. Devices of this type suffer from the disadvantage that they are generally complicated and, as a result, expensive and difficult to maintain.

It is an object of the present invention to provide an improved material handling apparatus which is relatively simple in construction and has relatively low maintenance.

According to the present invention there is provided material handling apparatus which is suitable for use with a holding receptacle the apparatus comprising a charging hopper having a first opening through which material can be loaded into the charging hopper and a second opening through which material can be discharged from the charging hopper said second opening being disposed below said first opening when the apparatus is in use, characterized in that the apparatus further includes a control member having a work head which is mounted for movement within said charging hopper about a pivot axis which extends generally laterally with respect to the normal upright operative position of the apparatus, the control member being pivotally movable about the pivot axis between a first position in which the work head is spaced from and disposed above the second opening, and a second position in which the work head is adjacent or within the second opening.

Thus the work head of the apparatus of the invention operates in a simple pendulum fashion and this in conjunction with the positioning of the openings enables material to pass under the influence of gravity from the first opening towards the second opening.

The arrangement is such that pivotal movement of the work head from the first to the second position causes material within the hopper to be pushed by the work head through the second opening. When the apparatus is in use with a holding receptacle the material discharged through the second opening from the hopper is arranged to enter the holding receptacle and is capable of being compacted within the holding receptacle by the work head.

The charging hopper may comprise a curved guide surface therein which extends between the first and second openings so as to define a slide for directing material towards the second opening. Desirably the curved guide surface is generally complementary to the arc of movement of the work head between the first and second positions, with the work head being disposed adjacent the guide wall surface and in close proximity thereto during movement between the first and second positions.

This arrangement greatly assists in ensuring that material which is fed to the apparatus via the first opening is efficiently transferred to the second opening.

The hopper may take any suitable form and in one advantageous arrangement comprises a side wall and a base wall with the first opening being in a top portion of the charging hopper and the second opening being disposed in the side wall in a region adjacent the base wall at a lower section thereof. The base wall may have the curved guide surface thereon. The control member may be arranged to pivot about the pivot axis which in one form is disposed above the second opening and generally in the same vertical plane. The work head may comprise a block having a front wall, a top wall and side walls, the front wall being arranged to push the material through the second opening and where necessary compact the material within the receptacle. The side walls may have a curved lower edge which is complementary to the curve guide surface the curved lower edge of the side walls of the work head being adjacent the curved guide surface of the charging hopper.

In one form, the top wall and side walls taper towards one another to a trailing edge section, that is whilst the work head is of the same width dimension at its trailing edge as it is at its front wall it is of reduced height as a result of the taper.

The control member may further include mounting arms which have the work head operatively connected to one thereof the other ends being mounted for pivotal movement about the pivot axis the mounting arms being arranged so that in said first position the first opening can be accessed. This can be as a result of the tapering of the work head towards its trailing edge which permits the first opening to be substantially clear of the work head even when the work head is in the first position. When the work head is in the first or raised position, the top wall is displaced in such a manner that it is adjacent one of the side walls of the hopper.

The top wall of the work head may form a cover above the second opening when the control member is in the second position so that material being loaded into the charging hopper will not interfere with the material being discharged through the second opening and when the work head is in the first position, the top wall is displaced in such a manner that it is adjacent one of the side walls of the hopper.

Drive means may be provided for causing movement of the control member between the first and second positions. Such drive means may be in the form of one or more hydraulic pistons/cylinder assemblies operatively interconnected between the mounting arms and the hopper. The piston/cylinder assemblies may be mounted on suitable pivot pins on the hopper and the mounting arms.

The apparatus according to the present invention and the holding receptacle with which it may be associated when in use, are in one form, mounted on a vehicle such as a truck or the like. In another arrangement the apparatus of the present invention may be used with a static holding receptacle.

The operation of the apparatus in its preferred form will hereinafter be described.

Material such as refuse can be loaded into the hopper through the first opening thereof. With the control member in the first or raised position the material falls onto the guide surface on the base of the hopper and is directed towards the second opening from where it passes into the holding receptacle.

Activation of the drive means causes the control member to move from the first position where the work head is raised to the second position where it is disposed adjacent the second opening and thereby forcing the material into the holding receptacle and when necessary compacting or compressing the material.

In the second or lowered position the top wall of the work head forms a barrier between the major interior of the hopper and the second opening thereby ensuring that any material deposited in the hopper with the control member in the second position does not interfere with the compressing action of the work head.

Further activation of the drive means causes the control member to return to the first position where the operation can be repeated.

It will be appreciated from the foregoing that the apparatus of the present invention provides a relatively simple and efficient mechanism which because of its simplicity has relatively low maintenance. In a preferred form because the work head moves between a raised and lowered position, gravity therefor assists in moving the material towards the second opening for compacting the material within the holding receptacle when the work head is lowered.

Preferred embodiments of the invention will hereinafter be described with reference to the accompanying drawings in which:

FIG. 1 is a schematic view of a refuse collecting vehicle incorporating apparatus according to the present invention;

FIG. 2 is a side elevation of apparatus according to the present invention;

Figure 3:
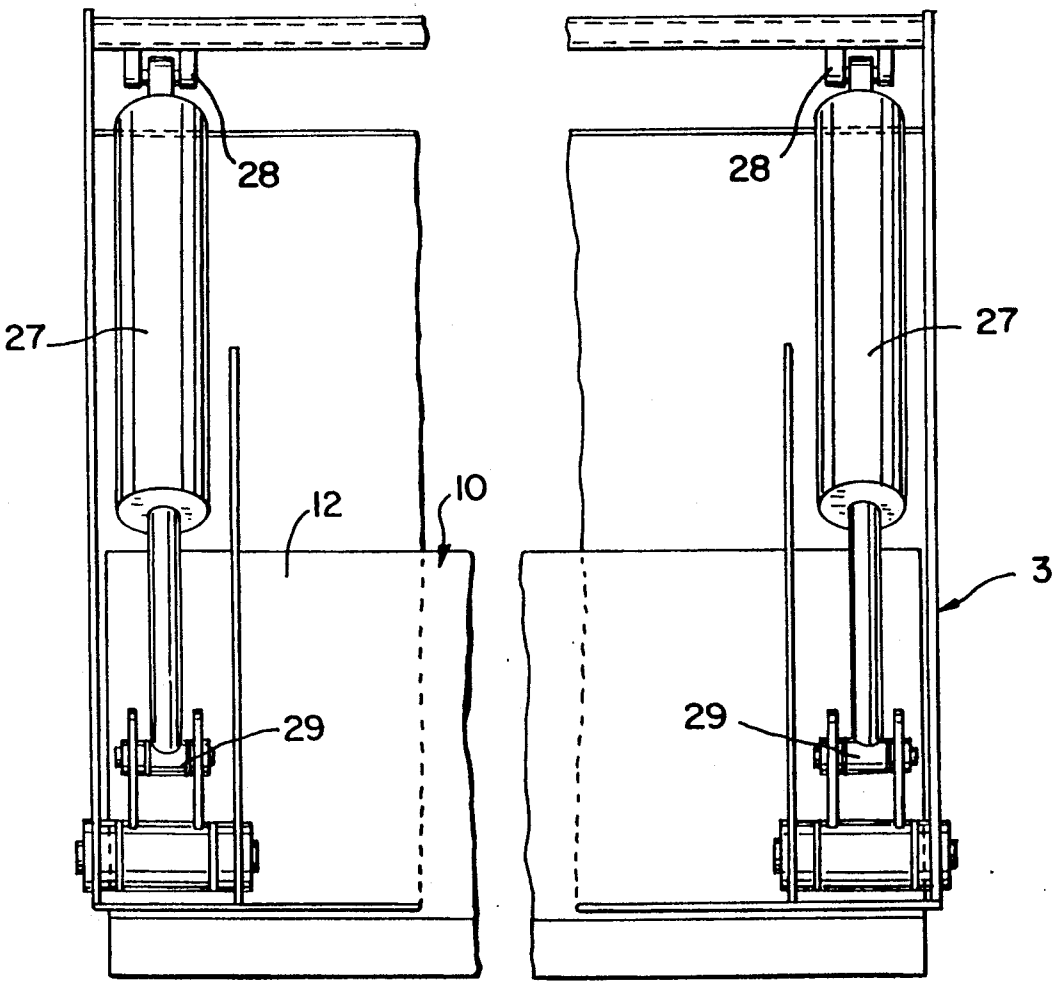
FIG. 3 is a plan view of the apparatus as shown in FIG. 2.

Referring to the drawings the apparatus generally indicated at 1 is shown mounted adjacent a collecting receptacle 50 in the form of a reinforced tank. The apparatus and receptacle may be mounted on a vehicle such as a truck 55. A loading arm 56 is arranged to pick up refuse bins and discharge the contents through chute 57 to the apparatus of the present invention. As mentioned earlier it is not necessary that the receptacle is mounted onto a vehicle but may simply be disposed in a suitable location.

Figure 4:
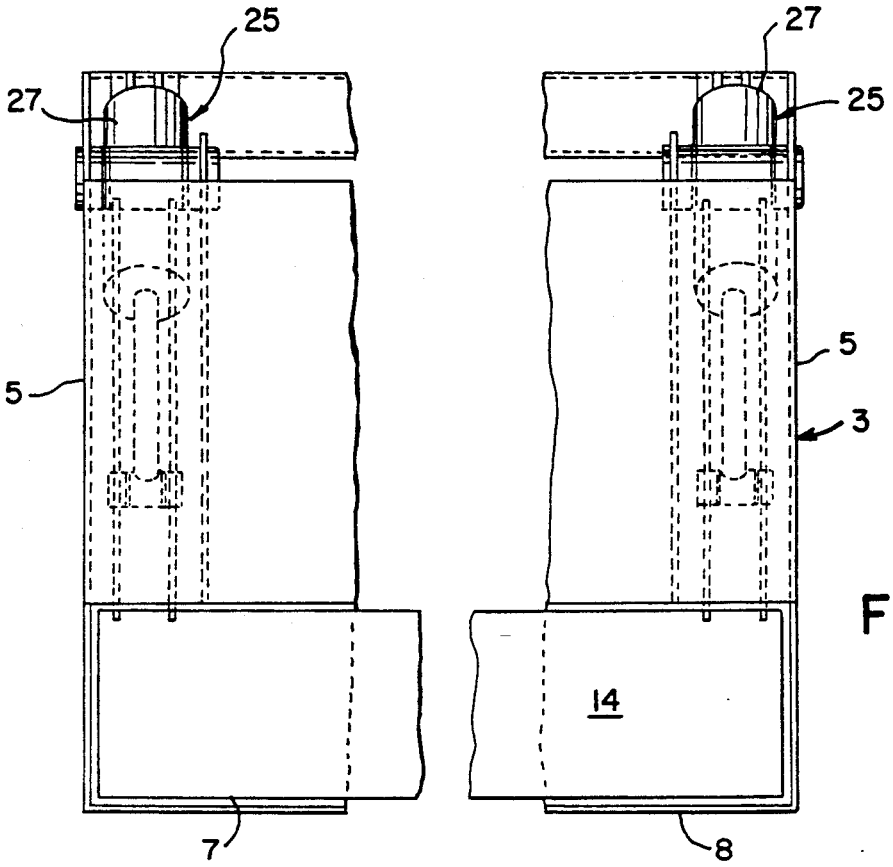
FIG. 4 is an end elevation of the apparatus shown in FIGS. 2 and 3.
Figure 5:
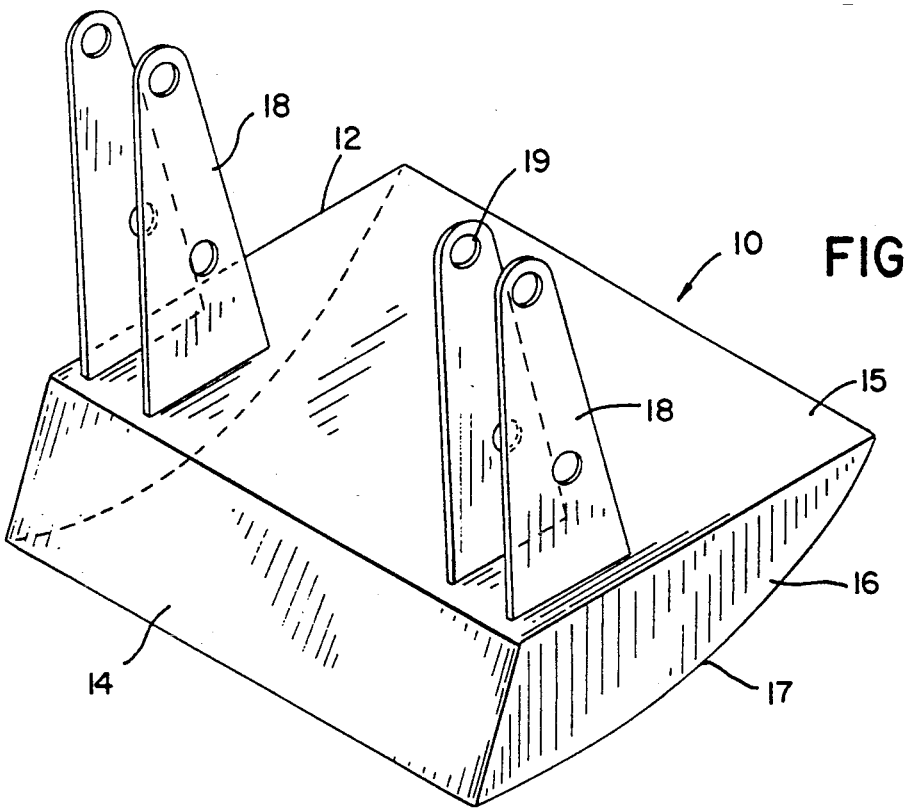
FIG. 5 is a schematic perspective view of a control member which forms part of the apparatus shown in FIGS. 2 to 4.

As best seen in FIGS. 2 to 5, the apparatus 1 includes a charging hopper 3 having a side wall 5 with a first opening 6 in its top and a second opening 7 in a lower region of the side wall 5. The hopper further includes a base wall 8 having a curved surface 9, which forms a slide directed from the first opening 6 towards the second opening 7. In the particular application shown in FIG. 1, material from chute 57 is directed through the first opening 6 of the apparatus and material is passed through the second opening 7 into receptacle 50.

The apparatus 1 further includes a control member 10 having a work head 12 disposed within the charging hopper 3 the control member 10 being mounted for movement about a pivot axis 20 which extends generally horizontally as shown. The work head 12 moves in an arc about the pivot axis 20 between a first or raised position in which the work head 12 is spaced from the second opening 7 and a second or lowered position in which the work head 12 is adjacent or within the second opening.

The work head 12, as shown is in the form of a block having a front wall 14 a top wall 15 and side walls 16. In operation the front wall 14 is arranged to push the material in the charging hopper 3 through the second opening 7 and where necessary compact the material within the receptacle 50.

The side walls 16 of the work head each have a curved lower edge 17 which is complementary to the curved guide surface 9 of the charging hopper 3 the curved lower edges 17 of the side wall of the work head being adjacent the curved guide surface of the charging hopper. As best seen in FIG. 2 the top wall 15 and side walls 16 converge towards one another in the direction of the trailing edge of work head 12. Thus when in the raised position as shown in FIG. 2, the work head does not interfere with opening 6 of the charging hopper 3.

The control member 10 further includes a pair of mounting arms 18 which have the work head 12 operatively connected to one thereof the other ends being mounted for pivotal movement about the pivot axis 20 in suitable bearings 19. The mounting arms 18 are disposed at the sides of the work head so as to ensure a minimum of interference at the first opening 6.

The top wall 15 of the work head 12 forms a cover above the second opening 7 when the control member is in the lowered or second position so that material being loaded into the hopper through opening 6 will not interfere with the material being discharged through the second opening. As best seen in FIG. 2, when the work head 12 is in the first or raised position, the top wall is positioned such that it is adjacent the side wall of the charging hopper 3.

Drive means 25 causes movement of the control member 10 between the first and second positions. As shown, the drive means 25 is in the form of hydraulic pistons/cylinder assemblies 27 operatively interconnected between the mounting arms 18 and the charging hopper 3. The piston/cylinder assemblies 27 are mounted on pivot pins 28 and 29 on the charging hopper 3 and the mounting arms 18 respectively.

In operation material such as refuse can be loaded into the charging hopper 3 through the first opening 6 thereof. With the control member 10 in the first or raised position the material falls onto the curved guide surface on the base of the charging hopper 3 and under the influence of gravity is directed towards the second opening 7 from where it passes into the holding receptacle 50.

Activation of the drive means 25 causes the control member 10 to move from the first position where the work head 12 is raised to the second position where it is disposed adjacent the second opening 7 and thereby forcing the material into the holding receptacle and when necessary compacting or compressing the material. As shown in FIG. 2, the arcuate length of the lower surface of control member 10 adjacent guide surface 9 is less than half the arcuate swing of the control member 10 between the first position and the second position.

In the second or lowered position the top wall 15 of the work head 12 forms a barrier over the second opening 7 thereby ensuring that any material deposited in the charging hopper 3 with the control member in the second position does not interfere with the compressing action of the work head.

Further activation of the drive means causes the control member to return to the first position where the operation can be repeated.

It will be appreciated from the foregoing that the apparatus of the present invention provides a relatively simple and efficient mechanism which because of its simplicity has relatively low maintenance. In a preferred form because the work head moves between a raised and lowered position, gravity therefor assists in moving the material through the second opening and compacting the material within the receptacle.

I claim:

1. Material handling apparatus suitable for use with a holding receptacle, said apparatus comprising;

a charging hopper (3) having a first opening (6) through which material can be loaded into the charging hopper (3) and a second opening (7) through which material can be discharged from the charging hopper (3), said second opening (7) being disposed below said first opening (6) when the apparatus is in use, said charging hopper (3) having a curved guide surface (9) therein which extends between said first and second openings (6, 7) so as to form a slide for directing material towards said second opening (7);

a control member (10) having a work head (12) which is mounted for movement within said charging hopper (3) about a pivot axis (20) which extends generally horizontally when said apparatus is in use, the control member (10) being pivotally movable about the pivot axis (20) between a first position in which the work head (12) is spaced from and disposed above the second opening (7), and a second position in which the work head is adjacent or within the second opening (7);

said curved guide surface (9) of said hopper being generally complementary to the arc of movement of the lower most part of the work head (12) between said first and second positions, said work head (12) being disposed adjacent said guide surface (9) and in close proximity thereto during movement between said first and second positions, said control member comprising a top surface (15) of said work head, and a lower surface curved to substantially the same arc as said guide surface, said top surface being shaped to act as a sloping surface when said work head (12) is in said first position to guide material towards the second opening (7), and wherein said top surface is at all times exposed to said hopper and said first opening, whereby material may enter into said first opening and said hopper irrespective of the position of the control member at and between said first position and said second position.

2. Material handling apparatus according to claim 1, wherein said charging hopper (3) comprises a side wall (5) and a base wall (8) with the first opening (6) being in a top portion of the charging hopper (3) and the second opening (7) being disposed in the side wall (5) in a region adjacent the base wall (8), said base wall having said curved guide surface (9) thereon.

3. Material handling apparatus according to claim 1, wherein said control member (10) comprises a block having a front wall (14), said top surface (15), said lower surface, and side walls (16), said front wall (14) being arranged to push the material through the second opening (7) and, where necessary, to compact the material within the receptacle, said side walls (16) each having a curved lower edge (17) which is curved complementary to the curved guide surface (9), the curved lower edges (17) of the side walls (16) and said lower surface of the control member being adjacent the curved guide surface (9) of the charging hopper (3), whereby when the control member (10) moves from the second position to the first position the leading edge of the control member defined by the end of said top surface most remote from the front wall (14) and said lower surface will tend to scrape material off said guide surface (9) onto said top surface (15).

4. Material handling apparatus according to claim 3, wherein said control member (10) further includes mounting arms (18) which have the work head (12) operatively connected to one end thereof, the other ends of said mounting arms being mounted for pivotal movement about the pivot axis (20), said mounting arms (18) being arranged so that in said first position the first opening of said charging hopper can be accessed.

5. Material handling apparatus according to claim 4, wherein the top surface (15) of the work head (12) forms a cover above the second opening (7) when the control member (10) is in the second position so that material being loaded into the charging hopper (3) through the first opening (6) will not interfere with the material being discharged through the second opening (7), and when the work head is in the first position, the top surface (15) is displaced in such a manner that it is adjacent one of the side walls of the hopper.

6. Material handling apparatus according to claim 4, further including drive means (25) for causing movement of the control member (10) and comprising at least one hydraulic piston and cylinder (27) assembly operatively interconnected between the mounting arms (18) and the charging hopper (3).

7. Material handling apparatus as claimed in claim 1, wherein the arcuate length of the lower surface of the control member (10) adjacent said guide surface (9) is less than half the arcuate swing of the control member (10) between the first position and the second position.

8. Material handling apparatus as claimed in claim 2, wherein said control member (10) comprises a block having a front wall (14), said top surface (15), said lower surface and side walls (16), said front wall (14) being arranged to push the material through the second opening (7) and, where necessary, to compact the material within the receptacle, said side walls (16) each having a curved lower edge (17) which is curved complementary to the curved guide surface (9), the curved lower edges (17) of the side walls (16) and said lower surface of the control member being adjacent the curved guide surface (9) of the charging hopper (3), whereby when the control member (10) moves from the second position to the first position the leading edge of the control member defined by the end of said top surface most remote from the front wall (14) and said lower surface will tend to scrape material off said guide surface (9) onto said top surface (15).

9. Material handling apparatus as claimed in claim 3, wherein the arcuate length of the lower surface of the control member (10) adjacent said guide surface (9) is less than half the arcuate swing of the control member (10) between the first position and the second position.

* * * * *